US007273034B2

(12) United States Patent
Arai et al.

(10) Patent No.: US 7,273,034 B2
(45) Date of Patent: Sep. 25, 2007

(54) THROTTLE CONTROL APPARATUS

(75) Inventors: Toshio Arai, Kawasaki (JP); Hidefumi Yoshida, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/291,785

(22) Filed: Dec. 2, 2005

(65) Prior Publication Data

US 2007/0125340 A1 Jun. 7, 2007

(51) Int. Cl.
*F02D 9/10* (2006.01)

(52) U.S. Cl. ..... 123/400

(58) Field of Classification Search ..... 123/399, 123/400

See application file for complete search history.

(56) References Cited

U.S. PATENT DOCUMENTS 6,725,833 B1 * 4/2004 Irihune et al. ..... 123/399
2004/0194757 A1 * 10/2004 Irihune et al. ..... 123/399
2005/0109315 A1 * 5/2005 Kamimura et al. ..... 123/399
2006/0000443 A1 * 1/2006 Kado et al. ..... 123/399
2006/0042594 A1 * 3/2006 Wayama et al. ..... 123/399
2006/0266329 A1 * 11/2006 Irihune et al. ..... 123/399

* cited by examiner

*Primary Examiner*—Erick Solis
(74) *Attorney, Agent, or Firm*—Bacon & Thomas, PLLC

(57) ABSTRACT

In a throttle control apparatus, one end of a throttle valve shaft supported rotatably on a throttle body is protruded from one side outer wall of the throttle body, the throttle lever mechanism comprising a drive lever, a link lever and a throttle lever is attached to the one end, and is surrounded by a lever accommodation wall formed on the one side outer wall, a cover closes an outer opening portion of the lever accommodation wall, and an opening sensor is mounted on the cover and engaged to the one end, whereby throttle body assembling workability and throttle valve shaft machining workability are improved, and the throttle control apparatus advantageous for a motorcycle can be provided.

1 Claim, 2 Drawing Sheets

PRIOR ART

THROTTLE CONTROL APPARATUS

BACKGROUND OF THE INVENTION

1. Field of the Invention

The present invention relates to a throttle body which controls air flow supplied to an engine in the fuel injection apparatus, and more particularly, relates to a throttle control apparatus used for a motorcycle.

2. Description of the Conventional Art

A conventional throttle body will be described below with reference to FIG. 2 which is a longitudinal section of the throttle body.

In FIG. 2, the reference numeral 10 indicates a throttle body having an intake passage 11 extending through laterally therein. A throttle valve shaft 12 is provided across the intake passage 11, and both ends of the throttle valve shaft 12 are rotatably supported on the throttle body 10.

Also, a throttle valve 13 is provided in the intake passage 11 for opening or closing the intake passage 11. The throttle valve 13 is mounted on the throttle valve shaft 12 so as to open or close the intake passage 11 in response to the rotation of the throttle valve shaft 12.

Another end 12*a* of the throttle valve shaft 12 is protruded rightward from an another side outer wall 10*a* of the throttle body 10 (right side as shown in FIG. 2), and a drive lever 14 is mounted integrally with the other end 12*a*.

The reference numeral 15 indicates a rotary shaft provided uprightly on the other side outer wall 10*a* of the throttle body 10. A throttle lever 16 is fixed to the rotary shaft 15 by means of a screw nut.

One end of an accelerator wire (not shown) for opening the throttle valve 13 and one end of an accelerator wire (not shown) for closing the throttle valve 13 are retained to the throttle lever 16, and other ends of the accelerator wires are connected to an acceleration grip, respectively.

When the acceleration grip is rotated by a driver, this rotation is transmitted to the throttle lever 16 through the accelerator wire to rotate the throttle lever 16 in response to the rotation of the acceleration grip.

The reference numeral 17 indicates a link lever which connects the throttle lever 16 and the drive lever 14. The rotation of the throttle lever 16 is transmitted to the drive lever 14 through the link lever 17. Due to the arrangement where the throttle lever 16 and the drive lever 14 are connected by means of the link lever 17, the rotation of the acceleration grip and the opening characteristic of the throttle valve 13 are made nonlinear.

Like this, a throttle lever mechanism T comprising the throttle lever 16, link lever 17 and drive lever 14 is mounted to the end 12*a* of the throttle valve shaft 12.

Also, a lever accommodation wall 10*e* is integrally formed with the other side outer wall 10*a* of the throttle body 10 to surround the periphery of the throttle lever mechanism T including the other end 12*a* of the throttle valve shaft 12, and right side opening portion 10*c* of the lever accommodation wall 10*e* is closed by a cover 18.

The throttle lever mechanism T is disposed in the accommodation space defined by the a lever accommodation wall 10*e* and the cover 18 so that the throttle lever mechanism T is protected against the outer obstacles or against splash of muddy water when the throttle body 10 is installed on such a portion of the motor cycle as directly exposed to the outside air.

The reference numeral 19 indicates a throttle opening sensor mounted to one end 12*b* of the throttle valve shaft 12 which protrudes from one side outer wall 10*d* of the throttle body 10. The output signal from the opening sensor 19 is inputted to ECU (not shown) and is used for the various control.

According to such conventional throttle control apparatus, the throttle lever mechanism T comprising the throttle lever 16, link lever 17 and drive lever 14 is attached to the other side outer wall 10*a* of the throttle body 10, and the cover 18 is attached to the opening portion 10*c* of the lever accommodation wall 10*e*, while the opening sensor 19 is mounted to the one end 12*b* of the throttle valve shaft 12 supported on the one side outer wall 10*d* of the throttle body 10.

With such structure, since assembling of the throttle lever mechanism and the opening sensor with the throttle body has to be carried out from the opposite directions, it is difficult to perform an efficient assembling operation Further, when maintenance work of the throttle lever mechanism T and the opening sensor 19 is done in a state where the throttle body is installed on the motorcycle, the working has to be done from the different directions, resulting in poor workability.

Furthermore, in the conventional throttle control apparatus, since the drive lever 14 is mounted to the other end 12*a* of the throttle valve shaft 12, a flat portion 12*c* is formed at the other end 12*a* so that the drive lever 14 is prevented from being rotated against the throttle valve shaft 12, while, since a flat groove of the opening sensor 19 is retained to the one end 12*b* of the throttle valve shaft 12, a flat portion 12*d* is formed at the one end 12*b* of the throttle valve shaft 12.

In the machining of the throttle shaft 12 which is made of hard steel such as cutting steel, one flat portion 12*c* is formed at the other end 12*a* of the throttle valve shaft 12, then the shaft 12 is reversed in position, and another flat portion 12*d* is formed at the one end 12*b* of the shaft 12, resulting in a difficulty of reducing the manufacturing cost of the throttle valve shaft 12.

Further, in the conventional throttle control apparatus, the lead wire of the opening sensor 19 is disposed at the side of the one side outer wall 10*d* of the throttle body 10, while the accelerator wire is disposed at the side of the other side outer wall 10*a* of the throttle body 10, i.e. the lead wire and accelerator wire are disposed astride the intake passage 11 of the throttle body 10. Thus, it is difficult to connect the wires for the motorcycle where the throttle body is disposed in a narrow space under a driver's seat.

SUMMARY OF THE INVENTION

The throttle control apparatus for a motorcycle in accordance with the present invention is made, taking the above mentioned problems into consideration, to provide a throttle control apparatus which is advantageously used in a motorcycle as follows.

A primary object of the present invention is to provide a throttle control apparatus with an excellent workability of assembling operation of the throttle body.

A further object of the present invention is to provide a throttle control apparatus capable of reducing the manufacturing cost of the throttle body by improving the machining workability of the throttle valve shaft.

A still further object of the present invention is to provide a throttle control apparatus with improved connection workability of the lead wire of the opening sensor and accelerator wire.

The above objects can be attained by providing a throttle control apparatus for a motorcycle comprising a throttle body having an intake passage which extends through therein, a throttle valve shaft which crosses the intake passage and is supported rotatably on the throttle body, and a throttle valve mounted on the throttle valve shaft to open or close the intake passage, wherein one end of the throttle valve shaft is disposed so as to protrude from one side outer wall of the throttle body, a flat portion is formed at the one end, a drive lever is attached to the flat portion, and the drive lever is connected to a throttle lever rotationally operated by an acceleration grip through a link lever, wherein a lever accommodating wall is formed integrally with the one side outer wall of said throttle body to surround a throttle lever mechanism composed of said throttle lever, the link lever, and the drive lever, an opening portion of the lever accommodating wall is held closed by a cover, and the throttle lever mechanism is disposed in an accommodating space formed by the lever accommodating wall and the cover, and wherein an opening sensor is mounted on the cover and engaged to the one end of the throttle valve shaft to detect rotation angle of the throttle valve shaft.

According to the throttle control apparatus of the present invention, the assembling of the throttle lever mechanism to the throttle body, the assembling of the cover, and the assembling of the opening sensor can be done from one direction, thereby the workability of assembling operation being improved.

Further, according to the present invention, since the flat portion is provided only at one end of the throttle valve shaft, thereby the machining workability of the throttle valve shaft is improved, and the manufacturing cost of the throttle body is effectively reduced.

Furthermore, according to the present invention, since the lead wire of the opening sensor and the accelerator wires connected to the throttle lever mechanism can be disposed on one side of the throttle body the connection workability of the wires after the throttle body is installed on the motorcycle can be improved, and in addition the workability of maintenance operation thereof can be improved.

Furthermore, according to the invention, since all of the throttle lever mechanism, cover, and opening sensor are disposed on one side outer wall of the throttle body together, the other side outer wall of the throttle body can be made neat, thereby the throttle control apparatus suitable for the motorcycle having the throttle body directly exposed to outside air can be provided.

Moreover, according to the invention, since the opening sensor is mounted to the throttle body through the cover, when the throttle body is heated by the thermal conduction from the engine or when cooled by the heat evaporation of fuel gas injected to the intake passage, such heat is hardly to transmitted directly to the opening sensor, thereby the output characteristics of the opening sensor is maintained stable without being influenced by the heat.

DETAILED DESCRIPTION OF PREFERRED EMBODIMENTS

Figure 1:
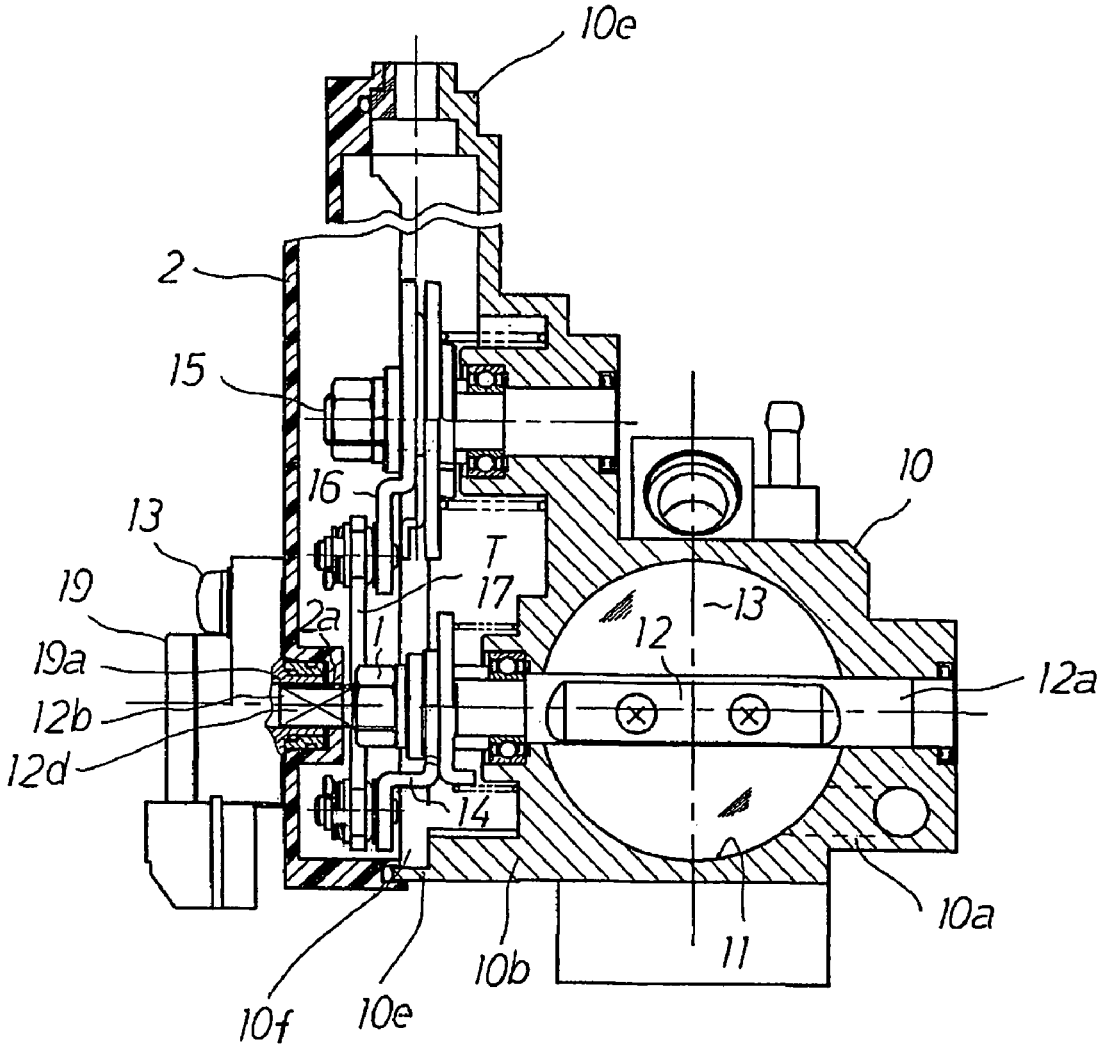
FIG. 1 is a longitudinal section showing a relevant part of one embodiment of the throttle control apparatus according to the present invention.
Figure 2:
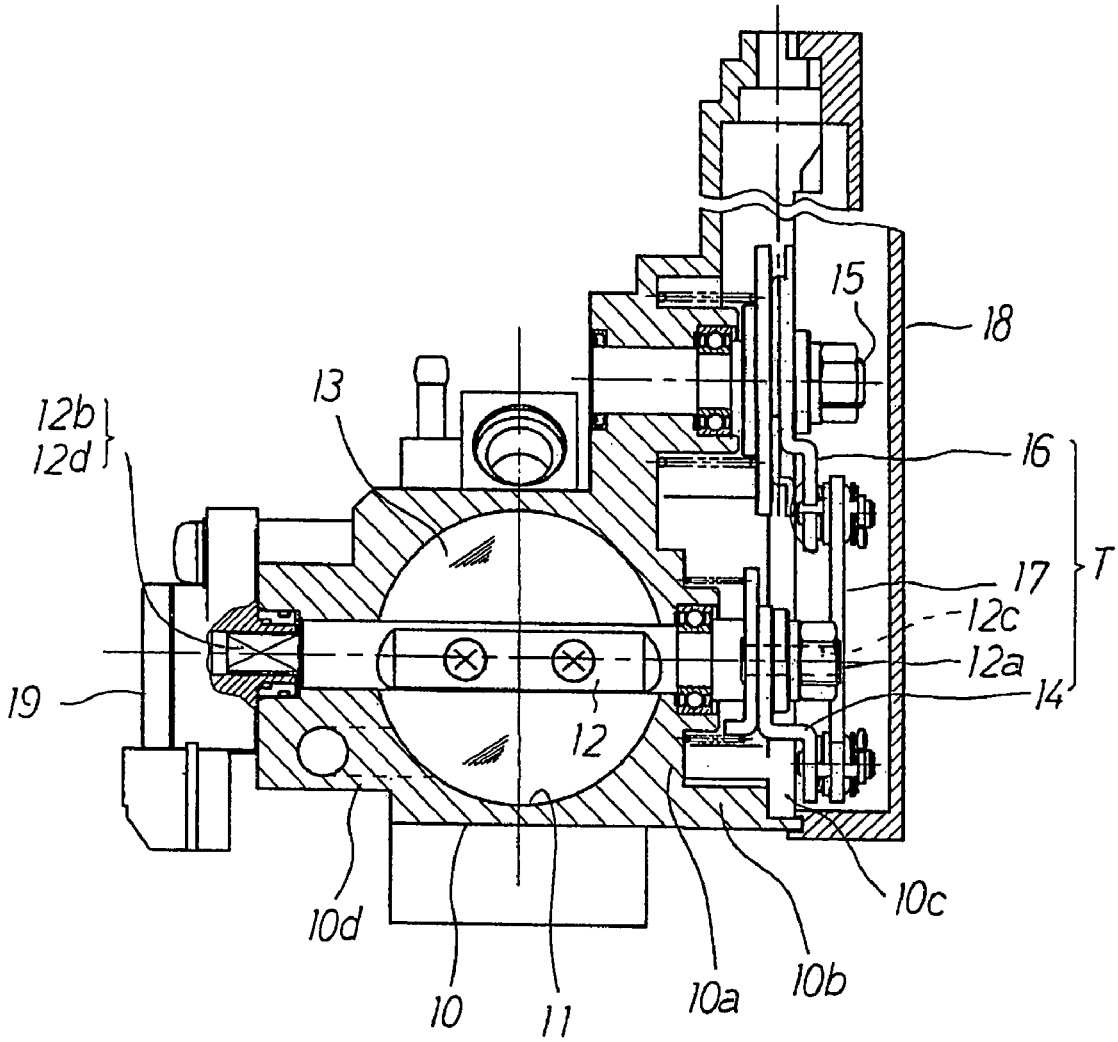
FIG. 2 is a longitudinal section showing a relevant part of the conventional throttle control apparatus.

The throttle control apparatus for a motorcycle according to the present invention will now be described with reference to FIG. 1 in which like parts as in FIG. 2 are identified by the same reference numerals.

Another end 12*a* of the throttle valve shaft 12 is rotatably supported on another side outer wall 10*a* of a throttle body 10, while one end 12*b* of the throttle valve shaft 12 is protruded leftward from one side outer wall 10*b* of the throttle body 10 and rotatably supported thereon. A flat portion 12*d* is formed at the one end 12*b* of the shaft 12.

To the one end 12*b* of the throttle valve shaft 12, a drive lever 14 is attached by means of a nut 1. The drive lever 14 is connected to a throttle lever 16 through a link lever 17. The throttle lever 16, the link lever 17 and the drive lever 14 constitute a throttle lever mechanism T. Such throttle lever mechanism T is engaged in the one side outer wall 10*b* of the throttle body 10.

A lever accommodation wall 10*e* to surround the throttle lever mechanism T is formed integrally with the one side outer wall 10*b* of the throttle body 10 with the outer opening portion 10*f* of the lever accommodation wall 10*e* being opened leftward.

The reference numeral 2 indicates a cover for closing the outer opening portion 10*f* of the lever accommodation wall 10*e*. The cover 2 has a through hole 2*a*, into which the flat portion 12*d* formed at the one end 12*b* of the throttle valve shaft 12 is inserted.

Next, assembling operation of throttle control apparatus will be described.

The throttle valve shaft 12 is rotatably attached to the throttle body 10 across the intake passage 11 so that the other end 12*a* thereof is rotatably supported on the other side outer wall 10*a* of the throttle body 10, and the one end 12*b* is rotatably supported on the one side outer wall 10*b* of the throttle body 10 and protruded leftward therefrom.

The drive lever 14 is attached to the one end 12*b* of the throttle valve shaft 12 by means of the nut 1, and the drive lever 14 is connected to the throttle lever 16 mounted on the rotary shaft 15 through the link lever 17.

Thus, the throttle lever mechanism T composed of the drive lever 14, the link lever 17 and the throttle lever 16 is brought to be disposed to the one side outer wall 10*b* of the throttle body 10 and disposed within the lever accommodation wall portion 10*e*.

Next, the cover 2 is attached to the outer opening portion 10*f* of the lever accommodation wall portion 10*e* so that the outer opening portion 10*f* is closed and the flat portion 12*d* formed at the one end 12*b* of the throttle valve shaft 12 penetrates the through-hole 2*a* of the cover 2 and is protruded rightward.

Next, the opening sensor 19 is fixed on the cover 2 by means of screws 3 so that a flat groove 19*a* is engaged with the flat portion 12*d* of the throttle valve shaft 12.

Thus, the throttle valve shaft 12 is brought to be rotatably supported to the throttle body 10, the drive lever 14 is mounted to one end 12*b* of the throttle valve shaft 12, and the throttle lever mechanism T composed of the drive lever 14, the link lever 17 and the throttle lever 16 is brought to be disposed in a accommodation space defined between the lever accommodation wall portion 10*e* and the cover 2 covering the accommodation wall portion 10*e*.

Then, the opening sensor 19 is fixed on the cover 2 by means of screws so that the flat groove 19*a* is engaged with the flat portion 12*d* of the throttle valve shaft 12.

In such an assembled structure, when an acceleration grip (not shown) is rotated by a driver, and the throttle lever 16 is rotated by the accelerator wire, the rotation of the throttle lever 16 is transmitted to the drive lever 14 through the link lever 17 to rotate the throttle valve shaft 12, thereby the throttle valve 13 opens or closes the intake passage 11 in response to the rotation of the acceleration grip.

According to the throttle control apparatus of the present invention, all of the assembling of the throttle lever mechanism T composed of the drive lever 14, the link lever 17 and the throttle lever 16 to the throttle body, the assembling of the cover 2, and the assembling of the opening sensor 19 are carried out one side of the throttle body 10 (left side as shown in FIG. 1), thereby the workability of assembling operation can be greatly improved.

Further, according to the present invention, since the flat portion 12*d* can be formed only at the one end 12*b* of the throttle valve shaft 12, thereby the machining workability of the throttle shaft 12 can be improved, and the manufacturing cost of the throttle body can be effectively reduced.

Furthermore, according to the present invention, since the throttle lever mechanism T, cover 2, and opening sensor 19 are disposed intensively on the one side outer wall 10*b* of the throttle body 10, the other side outer wall 10*a* of the throttle body 10 can be made neat, thereby a simple exterior appearance can be provided for the motorcycle having the throttle body directly exposed to outside air, and freedom of design can be improved.

Furthermore, according to the present invention, since the lead wire extending from the opening sensor 19 and the accelerator wire connecting the throttle lever 16 and acceleration grip can be disposed on one side of the throttle body 10, the workability of connection operation of the accelerator wire and lead wire in a state where the throttle body 10 is installed in a narrow space below a seat of a motorcycle can be greatly improved.

Moreover, according to the present invention, due to the provision of cover 2 between the opening sensor 19 and throttle body 10, particularly in case the cover 2 is made of synthetic resin material, thermal conduction between the throttle body 10 and the opening sensor 19 can be effectively blocked, thereby the output characteristics of the opening sensor can be maintained stable without being influenced by the change in temperature of the throttle body 10.

What is claimed is:

1. A throttle control apparatus comprising a throttle body having an intake passage which extends through therein, a throttle valve shaft which crosses the intake passage and is supported rotatably to the throttle body, and a throttle valve mounted on the throttle valve shaft to open and close the intake passage, wherein one end of the throttle valve shaft is disposed so as to protrude from one side outer wall of the throttle body, a flat portion is formed at the one end, a drive lever is attached to the flat portion, and the drive lever is connected to a throttle lever rotationally operated by an acceleration grip through a link lever, wherein a lever accommodating wall is formed integrally with the one side outer wall of said throttle body to surround a throttle lever mechanism composed of said throttle lever, the link lever, and the drive lever, an opening portion of the lever accommodating wall is held closed by a cover, and the throttle lever mechanism is disposed in an accommodating space formed by the lever accommodating wall and the cover, and an opening sensor is attached on the cover and engaged to the one end of the throttle valve shaft to detect rotation angle of the throttle valve shaft.

* * * * *